US005567298A

United States Patent [19]

DuBois et al.

[11] Patent Number: 5,567,298

[45] Date of Patent: Oct. 22, 1996

[54] METHOD OF OPERATING CHLOR-ALKALI CELLS

[75] Inventors: Donald W. DuBois, Irwin; Bernard A. Maloney, Murrysville; Stanley R. Pickens, Monroeville, all of Pa.

[73] Assignee: PPG Industries, Inc., Pittsburgh, Pa.

[21] Appl. No.: 841,898

[22] Filed: Feb. 25, 1992

Related U.S. Application Data

[63] Continuation of Ser. No. 637,104, Jan. 3, 1991, abandoned.

[51] Int. Cl.[6] ..... C25B 15/00; C25B 1/34

[52] U.S. Cl. ..... 205/350; 205/516

[58] Field of Search ..... 204/98, 128, 129, 204/295, 296; 205/516, 350

[56] References Cited

U.S. PATENT DOCUMENTS 3,755,103 8/1973 Grotheer et al. ..... 204/98

4,036,729 7/1977 Patil et al. ..... 204/296

4,169,774 10/1979 Kadija et al. ..... 204/295

*Primary Examiner*—Kathryn Gorgos

*Attorney, Agent, or Firm*—Edward J. Whitfield; Irwin M. Stein

[57] ABSTRACT

Disclosed is an improved method of making chlorine and alkali metal hydroxide, e.g., sodium hydroxide, in an electrolytic cell of the type wherein a liquid permeable diaphragm separates the anolyte from the catholyte, said method comprising adding to the anolyte, while the cell is operating, a hydrated aluminum silicate containing clay mineral, followed by lowering the pH of the anolyte by the addition of an inorganic acid and maintaining the anolyte at said lowered pH for a time sufficient to restore the cell to a predetermined current efficiency.

24 Claims, No Drawings

METHOD OF OPERATING CHLOR-ALKALI CELLS

This application is a continuation of application Ser. No. 07/637,105, filed Jan. 3, 1991, now abandoned.

BACKGROUND OF THE INVENTION

Chlorine, hydrogen and aqueous alkali metal hydroxide may be produced electrolytically in a diaphragm cell wherein alkali metal chloride brine, e.g., sodium or potassium chloride brine, is fed to the anolyte compartment of the cell, chlorine being evolved at the anode, the electrolyte percolating through a liquid permeable diaphragm into the catholyte compartment wherein hydroxyl ions and hydrogen are evolved at the cathode.

The diaphragm which separates the anolyte compartment from the catholyte compartment must be sufficiently porous to permit hydrodynamic flow of brine but must also inhibit back migration of hydroxyl ions from the catholyte compartment into the anolyte compartment as well as prevent mixing of evolved hydrogen and chlorine gases which could pose an explosive hazard.

Asbestos or asbestos in combination with various polymeric resins, particularly fluorocarbon resins (so-called modified asbestos) have long been used as diaphragm materials. Recently, due primarily to the health hazards posed by asbestos, numerous non-asbestos or synthetic diaphragms have been developed and are extensively described in the art. Such synthetic diaphragms are typically made of fibrous polymeric material resistant to the corrosive atmosphere of the cell and are typically made using perfluorinated polymeric material, e.g., polytetrafluoroethylene (PTFE). Such diaphragms may also contain various other modifiers and additives, e.g., inorganic fillers, pore formers, wetting agents, ion exchange resins the like. Some of said synthetic diaphragms are described, for example, in U.S. Pat. Nos. 4,036,729; 4,126,536; 4,170,537; 4,210,515; 4,606,805; 4,680,101; 4,720,334 and 4,853,101.

Regardless of the nature of the diaphragm, i.e., be it asbestos, modified asbestos or synthetic, variations are often observed in cell operating characteristics, e.g., variations in diaphragm permeability and porosity, cell voltage and current efficiency.

OBJECT OF THE INVENTION

It is the principal object of this invention to provide an improved method of operating electrolytic chlor-alkali cells which method improves cell operating characteristics by enabling desirably low cell voltage and desirably high current efficiency while controlling diaphragm porosity so as to maintain desirable brine head differential.

THE INVENTION

The foregoing object and others are accomplished in accordance with this invention by adding finely divided clay mineral to the anolyte of an operating chlor-alkali cell and lowering the pH of the anolyte after addition of the clay mineral for a time sufficient to restore cell operating characteristics to a predetermined level of current efficiency.

Clay minerals are naturally occurring hydrated silicates of aluminum, iron or magnesium, both crystalline and amorphous. Clay minerals suitable for use in accordance with the invention include the kaolin minerals, montmorillonite minerals, illite minerals, glauconite, attapulgite and sepiolite.

Clay minerals preferred for use according to the invention are of the class commonly referred to as "Fuller's earth". Of the Fuller's earth type clay minerals, attapulgite is particularly preferred. Attapulgite is a crystalline hydrated magnesium aluminum silicate having a three dimensional chain structure and is commercially available in a variety of grades and average particle sizes, ranging from about 0.1 micron up to about 20 microns. An attapulgite clay product having an average particle size of about 0.1 micron and available from Engelhard Corporation under the trademark, "Attagel®" has been found particularly useful in the practice of the process of this invention.

While the quantity of clay mineral added to the anolyte will vary somewhat depending on cell operating characteristics, cell geometry, cell capacity and the like, sufficient clay mineral is added to provide the desired diaphragm permeability and current efficiency. Plant scale designed experiments were conducted to determine the optimum quantity of clay mineral and, basis these experiments, from about 0.002 to about 0.02 pounds per square foot of diaphragm cathode surface area, in combination with lowering the pH of the anolyte, will restore cell operating efficiency to the desired level.

In accordance with the invention, the anolyte pH is conveniently and easily lowered to the desired range by the addition of inorganic acid. Although mineral acids, e.g., hydrochloric acid, may be used, phosphoric acid is preferred since it provides a buffering action enabling easier pH control over the time period necessary to restore the cell to the desired level of operating efficiency. Plant scale designed experiments indicate that sufficient acid be added to maintain the pH of the anolyte in the range of from about 0.9 to about 2.0 for at least about 45 minutes up to about 2 hours following clay mineral addition. Basis these experiments, optimal results appear to be obtained by adding to the anolyte about 0.01 pound of attapulgite clay per square foot of cathode surface area followed immediately by lowering the pH to about 1.0 and maintaining the pH thereat for about 1 hour. After treatment in accordance with the invention, i.e., clay addition and acid treatment for the requisite time, the cell will recover to its normal operating pH in about 3 to 4 hours following treatment, which normal operating pH is typically in the range of from about 3.5 to about 4.5.

It has also been found that addition of water soluble magnesium salts to the anolyte along with addition of clay mineral and pH adjustment are advantageous, particularly when phosphoric acid is used for pH adjustment. Addition of magnesium salts at a level of up to about 0.01 pound per square foot of cathode surface area enables better control of the hydrodynamic head of brine from the catholyte to the anolyte compartments of the cell. Exemplary water soluble magnesium salts contemplated for use in accordance with this aspect of the invention include magnesium chloride, magnesium sulfate, magnesium phosphate or mixtures thereof.

Treatment of the on-line, operating electrolytic chlor-alkali cell, in accordance with this invention, can be employed at cell start-up to assure operation at the desired current efficiency level or at any time during operation that cell current efficiency drops below the desired level. Typically, an electrolytic cell of the type treated in accordance with the invention should operate at a current efficiency of at least about 90 percent and preferably at least about 95 percent.

The diaphragm may be made of any material or combination of materials known to the chlor-alkali art and can be prepared by any technique known to the chlor-alkali art. Such diaphragms are typically made substantially of fibrous material, such as traditionally used asbestos and more recently of plastic fibers such as polytetrafluoroethylene. Such diaphragms are typically prepared by vacuum depositing the diaphragm material from a liquid slurry onto a permeable substrate, e.g., a foraminous cathode. The foraminous cathode is electro-conductive and may be a perforated sheet, a perforated plate, metal mesh, expanded metal mesh, woven screen, metal rods or the like, having openings typically in the range of from about 0.05 to about 0.125 inch in diameter. The cathode is typically fabricated of iron, iron alloy or some other metal resistant to the cell environment, e.g., nickel. The diaphragm material is typically deposited on the cathode substrate in an amount ranging from about 0.1 to about 1.0 pound (dry weight) per square foot of substrate, the deposited diaphragm typically having a thickness of from about 0.1 to about 0.25 inch. Following deposition of the diaphragm material on the cathode substrate, the cathode assembly is dried or heat cured at a suitable temperature in a manner known to the chlor-alkali art.

The invention is further illustrated but is not intended to be limited by the following Examples.

EXAMPLE 1

A non-asbestos, fibrous polytetrafluoroethylene (PTFE) diaphragm was prepared by vacuum deposition onto a laboratory scale steel mesh cathode from an aqueous slurry of approximately the following weight percent composition:

0.5% of CELLOSIZE® QP 52 000H hydroxy ethyl cellulose (product of Union Carbide Corp.);

0.08% of 1 Normal sodium hydroxide solution;

1.0% of AVANEL® N-925 non-ionic surfactant (product of PPG Industries, Inc.);

0.2% of UCON® LO-500antifoaming agent (product of Union Carbide Corp.);

0.02% of UCARCIDE® 250 50% aqueous glutaraldehyde antimicrobial solution (product of Union Carbide Corp.);

0.38% of ¼" chopped 6.67 denier TEFLON® polytetrafluoroethylene floc (product of E. I. DuPont deNemours & Co.);

0.18% of 6.5 micron×⅛" chopped DE fiberglass with 610 binder (product of PPG Industries Inc.);

0.1% of SHORT STUFF® GA 844 polyethylene fibers (product of Minifibers Corp.);

1.1% of polytetrafluoroethylene microfibers having a length of 0.2–0.5 mm and a diameter of 10–15 microns, prepared as described in U.S. Pat. No. 5,030,403, the teachings of which are incorporated by reference herein vis a vis preparation of said microfibers.

0.016% of NAFION® 601 solution of ion exchange material having sulfonic acid functional groups (product of Dupont); and the balance, water.

A portion of the above slurry was used to deposit a diaphragm on a cathode screen constructed of 6 mesh, mild steel such as used in commercial chlorine cells. The diaphragm was deposited by drawing said portion of slurry under vacuum, the vacuum being gradually increased to 18" Hg over a 15 minute period and held at 18" Hg until about 900 ml of slurry was drawn through the cathode screen. Following deposition of the diaphragm material on the cathode screen, the assembly was dried for about 1 hour at a temperature of about 118° C. and installed in a laboratory scale chlor-alkali cell. The dry diaphragm containing about 0.34 pound of material per square foot of cathode surface area was then immersed in an aqueous solution of about 25.6 wt-% zirconyl chloride for about 20 minutes. The diaphragm absorbed about 22.5 grams of solution. The wet diaphragm was then immersed overnight in an aqueous 25 wt-% sodium hydroxide solution to precipitate zirconium hydrous oxide in the interstices of the fibrous matrix thereof. The diaphragm assembly was them dried in an oven at about 117° C. for about 100 minutes, installed in the cell and operated at an initial current efficiency of about 91.1 percent.

EXAMPLE 2

A commercial scale electrolytic chlor-alkali cell provided with a diaphragm prepared from a slurry such as described in Example 1 was operated at a voltage of 3.25 volts and an anolyte level of 11.5 inches of brine. The cell was producing 128 g/l NaOH product and chlorine product with 0.03 vol % hydrogen and 1.61 vol % oxygen. The cell current efficiency was 93.6%.

One pound of attapulgite clay and 2 gallons of 85 wt % phosphoric acid were added to the anolyte. The following day the cell was operating with a voltage of 3.26 volts and an anolyte level of 16.5 inches of brine. The cell was producing 136 g/l NaOH and chlorine gas containing 0.02% hydrogen and 1.17% oxygen. The current efficiency was improved to 94.8%.

EXAMPLE 3

An electrolytic chlor-alkali cell as described in Example 2 was during operation observed to be producing 136 g/l NaOH and chlorine gas containing 0.03 vol % hydrogen and 1.30 vol % oxygen. The anolyte level was 9.0 inches of brine, the cell voltage was 3.24 volts and the current efficiency was 94.4%. The cell was treated with 1 lb. of attapulgite clay and 2 gallons of phosphoric acid as in Example 2. The following day the cell was producing 142 g/l NaOH and chlorine containing 0.03 vol % hydrogen and only 0.91 vol % oxygen. The cell voltage following the treatment was 3.25 volts, the anolyte level 13.0 inches of brine and the current efficiency was 95.2%.

EXAMPLE 4

An electrolytic chlor-alkali cell as described in Example 2 was during operation observed to be producing 137 g/l NaOH and chlorine gas containing 0.04 vol % hydrogen and 1.08 vol % oxygen. The anolyte level was 9.5 inches of brine, the cell voltage was 3.19 volts and the current efficiency was 94.0%. The cell anolyte was treated with 2 lbs. of attapulgite clay, 1 lb. $MgHPO_4.3H_2O$ powder and 2 gallons of phosphoric acid. The following day the cell was producing 133 g/l NaOH and chlorine containing 0.03 vol % hydrogen and 0.96 vol % oxygen. The cell voltage following the treatment was 3.21 volts, the anolyte level was 12.5 inches of brine and the current efficiency was 94.3%.

EXAMPLE 5

An experiment was Conducted with 18 commercial scale chlor-alkali cells wherein about 0.01 pound of attapulgite clay per square foot of cathode surface area was added to the anolyte of the operating cells followed by pH adjustment of the anolyte to about 1.0 using hydrochloric acid and maintaining the pH of the anolyte at about 1.0 for about 1 hour. Over all of the cells tested, the current efficiency increased on average of about 1.5 percent when treated in accordance with the method of the invention.

It is to be understood that although the invention has been illustrated using a preferred asbestos-free synthetic diaphragm, i.e., one composed principally of PTFE fibers, (as described, e.g., in U.S. Pat. No. 4,720,334), the invention is applicable for use in chlor-alkali cells using other types of synthetic diaphragms as well as asbestos or modified asbestos diaphragms, since the crux of the invention resides in treating the anolyte with clay mineral followed by lowering the anolyte pH following addition of the clay mineral.

We claim:

1. In the method of producing chlorine and alkali metal hydroxide in an electrolytic chlor-alkali cell having an anolyte compartment containing an anode, a catholyte compartment containing a cathode, and a liquid-permeable diaphragm of a non-asbestos fibrous synthetic material resistant to cell operating conditions, said diaphragm separating the anolyte compartment from the catholyte compartment, wherein alkali metal chloride brine is fed to the anolyte compartment of the cell, and wherein the cell electrolyzes said alkali metal chloride at a less than desired current efficiency, wherein the improvement comprises increasing current efficiency of said cell while the cell is operating by the sequential steps of (a) adding clay mineral to the anolyte compartment, (b) lowering the pH of the anolyte to within the range of from about 0.9 to about 2.0, and (c) maintaining said lowered pH for from about 45 minutes to about 2 hours to increase the current efficiency of the cell.

2. The method of claim 1 wherein the alkali metal chloride brine is sodium chloride brine.

3. The method of claim 1 wherein the synthetic diaphragm is prepared from perfluorinated polymeric material.

4. The method of claim 3 wherein the perfluorinated material is polytetrafluoroethylene fibers.

5. The method of claim 3 wherein the clay mineral is selected from the group consisting of kaolin minerals, montmorillonite minerals, illite minerals, glauconite and sepiolite.

6. The method of claim 5 wherein the clay mineral is a montmorillonite mineral, and the montmorillonite mineral is attapulgite.

7. The method of claim 5 wherein the pH of the anolyte is lowered with an inorganic acid selected from the group consisting of hydrochloric acid, phosphoric acid and mixtures of such inorganic acids.

8. The method of claim 7 wherein an inorganic magnesium salt is also added to the anolyte in step (a).

9. The method of claim 8 wherein the inorganic magnesium salt is a magnesium phosphate salt, magnesium chloride or mixtures of such magnesium salts.

10. The method of claim 9 wherein from about 0.002 to about 0.02 pounds of clay mineral per square foot of diaphragm cathode surface area is added to the anolyte.

11. The method of claim 10 wherein up to about 0.01 pounds of magnesium salt per square foot of diaphragm cathode surface area is added to the anolyte.

12. In the method of producing chlorine and sodium hydroxide in an electrolytic chlor-alkali cell having an anolyte compartment containing an anode, a cathode compartment containing a cathode, and a liquid-permeable non-abestos diaphragm of fibrous perfluorinated polymeric synthetic material resistant to cell operating conditions, said diaphragm separating the anolyte compartments from the catholyte compartment, wherein sodium chloride brine is fed to the anolyte compartment of the cell, and wherein the cell electrolyzes said sodium chloride at a less than desired current efficiency, wherein the improvement comprises increasing current efficiency of said cell while the cell is operating by the sequential steps of (a) adding clay mineral to the anolyte compartment, (b) lowering the pH of the anolyte to within the range of from about 0.9 to about 2.0, and (c) maintaining said lowered pH for from about 45 minutes to about 2 hours to increase the current efficiency of the cell.

13. The method of claim 12 wherein the perfluorinated polymeric material is polytetrafluoroethylene fibers.

14. The method of claim 13 wherein the clay mineral is a montmorillonite mineral.

15. The method of claim 14 wherein the montmorillonite mineral is attapulgite.

16. The method of claim 15 wherein from about 0.002 to about 0.02 pounds of clay mineral per square foot of diaphragm cathode surface area is added to the anolyte.

17. The method of claim 14 wherein an inorganic magnesium salt is also added to the anolyte in step (a).

18. The method of claim 17 wherein the magnesium salt is selected from the group consisting of magnesium chloride, a magnesium phosphate salt, and mixtures of said magnesium salts.

19. The method of claim 18 wherein up to about 0.01 pounds of magnesium salt per square foot of diaphragm cathode surface area is added to the anolyte.

20. The method of claim 17 wherein the pH of the anolyte is lowered with an inorganic acid selected from the group consisting of hydrochloric acid, phosphoric acid and mixtures of such inorganic acids.

21. The method of claim 20 wherein from about 0.002 to about 0.02 pounds of montmorillonite mineral per square foot of diaphragm cathode surface area is added to the anolyte, the montmorillonite mineral is attapulgite, and the inorganic magnesium salt is selected from the group consisting of magnesium chloride, a magnesium phosphate salt, and mixtures of such magnesium salts.

22. The method of claim 21 wherein up to about 0.01 pounds of magnesium salt per square foot of diaphragm cathode surface area is added to the anolyte.

23. The method of claim 22 wherein the inorganic acid is phosphoric acid, the magnesium salt is magnesium hydrogen phosphate, the pH is lowered to about 1 and the pH is maintained at the lowered level for about 1 hour.

24. The method of claim 14 wherein the pH of the anolyte is lowered with an inorganic acid selected from the group consisting of hydrochloric acid, phosphoric acid and mixtures of such inorganic acids.

* * * * *